US012371809B2

(12) United States Patent
Chen et al.

(10) Patent No.: US 12,371,809 B2
(45) Date of Patent: Jul. 29, 2025

(54) MANUFACTURING METHOD OF ALUMINUM-BASED ARTICLE WITH MULTI-ANGLE VISUAL COLOR CHANGE CHARACTERISTICS

(71) Applicant: CATCHER TECHNOLOGY CO., LTD., Tainan (TW)

(72) Inventors: Wen-Ding Chen, Tainan (TW); Bo-Wei Lai, Tainan (TW); Shih-Wei Lee, Tainan (TW)

(73) Assignee: CATCHER TECHNOLOGY CO., LTD., Tainan (TW)

( * ) Notice: Subject to any disclaimer, the term of this patent is extended or adjusted under 35 U.S.C. 154(b) by 0 days.

(21) Appl. No.: 18/634,062

(22) Filed: Apr. 12, 2024

(65) Prior Publication Data

US 2024/0344229 A1 Oct. 17, 2024

(30) Foreign Application Priority Data

Apr. 14, 2023 (TW) ..... 112114016

(51) Int. Cl.

| | |
|---|---|
| ***C25D 11/12*** | (2006.01) |
| ***C25D 11/08*** | (2006.01) |
| ***C25D 11/10*** | (2006.01) |
| ***C25D 11/16*** | (2006.01) |
| ***C25D 11/18*** | (2006.01) |
| ***C25D 11/24*** | (2006.01) |

(52) U.S. Cl.

CPC ..... *C25D 11/12* (2013.01); *C25D 11/08* (2013.01); *C25D 11/10* (2013.01); *C25D 11/243* (2013.01); *C25D 11/246* (2013.01)

(58) Field of Classification Search

CPC ..... C25D 11/024; C25D 11/12; C25D 11/16; C25D 11/18; C25D 11/24; C25D 11/243; C25D 11/246

USPC ..... 205/175, 229

See application file for complete search history.

(56) References Cited

FOREIGN PATENT DOCUMENTS

| | | | | | |
|---|---|---|---|---|---|
| CN | 102691085 A | | 9/2012 | | |
| CN | 106191957 A | | 2/2016 | | |
| CN | 109267134 A | * | 1/2019 | ..... | C25D 11/08 |
| CN | 110158135 A | * | 8/2019 | ..... | C25D 11/08 |
| CN | 110541181 B | * | 5/2021 | ..... | C25D 11/08 |

(Continued)

*Primary Examiner* — Edna Wong

(74) *Attorney, Agent, or Firm* — Li & Cai Intellectual Property (USA) Office

(57) ABSTRACT

A manufacturing method of an aluminum-based article having multi-angle visual color change characteristics is provided. The manufacturing method includes the steps of providing an aluminum-based article and performing a first anodizing treatment that at least includes cycling a first operation mode 50 times to 80 times on the aluminum-based article. The first operation mode includes a first constant-current density stage followed by a current density continuous-increasing stage. In the first constant-current density stage, a first current density is controlled to be constant in a range from 0.1 A/dm$^2$ to 1.0 A/dm$^2$ for 60 seconds to 120 seconds. In the current density continuous-increasing stage, the first current density is controlled to continuously increase by 5 to 10 increments, and each of the increments is in a range from 0.1 A/dm$^2$ to 0.5 A/dm$^2$ and within a time period from 3 seconds to 10 seconds.

17 Claims, 8 Drawing Sheets

(56) References Cited

FOREIGN PATENT DOCUMENTS

| | | | | | |
|---|---|---|---|---|---|
| EP | 1046514 | A2 | * | 10/2000 | ..... B41N 3/034 |
| TW | 200424360 | A | | 11/2004 | |
| TW | 201331421 | A1 | | 8/2013 | |
| WO | WO-2010065989 | A1 | * | 6/2010 | ..... B81C 1/00047 |
| WO | WO2020074754 | A1 | | 4/2020 | |

* cited by examiner

MANUFACTURING METHOD OF ALUMINUM-BASED ARTICLE WITH MULTI-ANGLE VISUAL COLOR CHANGE CHARACTERISTICS

CROSS-REFERENCE TO RELATED PATENT APPLICATION

This application claims the benefit of priority to Taiwan Patent Application No. 112114016, filed on Apr. 14, 2023. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a surface treatment and coloring process of aluminum alloys, and more particularly to a manufacturing method of an aluminum-based article having multi-angle visual color change characteristics.

BACKGROUND OF THE DISCLOSURE

Light metals generally refer to metals with a density of less than 5 g/cm$^3$. Current portable electronic products are developed towards being light, thin, short and small. Aluminum alloy has become a popular type of material for manufacturing housings and mechanical components of portable electronic devices due to its excellent physical and mechanical properties.

Aluminum alloy articles usually undergo a surface treatment such as an anodizing treatment to form an anodized oxide film for preventing aluminum alloy from direct exposure to air, decorating an aluminum alloy surface, and improving wear and corrosion resistances of aluminum alloy. However, general anodizing techniques require a dyeing process for surface coloring of aluminum alloy materials, and can only produce a single color or gradient color effect. Although the existing technology, through surface evaporation, can allow multiple colors to be presented as the viewing angle changes, a process therefor requires relatively high costs and is complicated. In addition, a surface treatment method of attaching a color changing film can only be adapted to simpler structures such as planar structures.

SUMMARY OF THE DISCLOSURE

In response to the above-referenced technical inadequacies, the present disclosure provides a manufacturing method of an aluminum-based article having multi-angle visual color change characteristics, which can produce a color gradient and multiple color variations on an aluminum alloy surface by a special pulse-type anodizing treatment optionally cooperated with a general anodizing treatment and/or a dyeing treatment.

In one aspect, the present disclosure provides a manufacturing method of an aluminum-based article having multi-angle visual color change characteristics, which includes: providing an aluminum-based article; and performing a first anodizing treatment including cycling a first operation mode 50 times to 80 times on the aluminum-based article. The first operation mode includes a first constant-current density stage followed by a current density continuous-increasing stage. In the first constant-current density stage, a first current density is controlled to be constant in a range from 0.1 A/dm$^2$ to 1.0 A/dm$^2$ for 60 seconds to 120 seconds. In the current density continuous-increasing stage, the first current density is controlled to continuously increase by 5 to 10 increments, and each of the increments is in a range from 0.1 A/dm$^2$ to 0.5 A/dm$^2$ and within a time period from 3 seconds to 10 seconds.

In one of the possible or preferred embodiments, the first anodizing treatment includes cycling a second operation mode 10 times to 50 times after the cycling operation of the first operation mode. The second operation mode includes a second constant-current density stage followed by a high current density pulse stage. In the second constant-current density stage, a second current density is controlled to be constant in a range from 0.3 A/dm$^2$ to 1.0 A/dm$^2$ for 70 seconds to 120 seconds. In the high current density pulse stage, the second current density is increased to a baseline current density and a plurality of micro-pulses greater than 0.5-1 A/dm$^2$ of the baseline current density are generated, and each of the micro-pulses is within a time period from 5 seconds to 15 seconds.

In one of the possible or preferred embodiments, the first anodizing treatment is performed in a first electrolytic solution with a temperature ranging from 10° C. to 20° C. The first electrolytic solution includes 5 wt % to 15 wt % of sulfuric acid, 5 wt % to 15 wt % of oxalic acid, or the combination thereof, based on a total weight thereof being 100 wt %.

In one of the possible or preferred embodiments, the first electrolytic solution includes 1 wt % to 10 wt % of glycerol.

In one of the possible or preferred embodiments, before the step of performing the first anodizing treatment, the manufacturing method further includes: subjecting the aluminum-based article to chemical polishing, such that an outer surface of the aluminum-based article has a gloss ranging from 80 GU to 1000 GU at a 60 degree angle.

In one of the possible or preferred embodiments, after the step of performing the first anodizing treatment, the manufacturing method further includes: performing a second anodizing treatment on the aluminum-based article undergoing the first anodizing treatment. The second anodizing treatment is performed at an operating voltage from 10V to 15V for 0.5 minutes to 10 minutes.

In one of the possible or preferred embodiments, the second anodizing treatment is performed in a second electrolytic solution with a temperature ranging from 50° C. to 70° C. The second electrolytic solution includes 5 wt % to 15 wt % of sulfuric acid, 5 wt % to 20 wt % of acetic acid, 2 wt % to 10 wt % of phosphoric acid, or any combination thereof, based on a total weight thereof being 100 wt %.

In one of the possible or preferred embodiments, after the step of performing the first anodizing treatment or the second anodizing treatment, the manufacturing method further includes: performing a dyeing treatment on the aluminum-based article undergoing the first anodizing treatment or the second anodizing treatment, such that a plurality of pores of a porous aluminum oxide layer formed by the first anodizing treatment or the second anodizing treatment are filled with at least one dye.

In one of the possible or preferred embodiments, after the step of performing the dyeing treatment, the manufacturing method further includes: performing a hole sealing treatment on the aluminum-based article undergoing the dyeing treatment.

In one of the possible or preferred embodiments, the hole sealing treatment includes forming a transparent sealing layer on the porous aluminum oxide layer to seal the pores. The transparent sealing layer includes a polymer material selected from the group consisting of polyurethane, polycarbonate, aminosiloxane, epoxy siloxane, and a nano-silicon composite material.

In conclusion, by virtue of performing a first anodizing treatment that includes cycling a first operation mode 50 times to 80 times on the aluminum-based article, the first operation mode including a first constant-current density stage followed by a current density continuous-increasing stage, the first constant-current density stage controlling a first current density to be constant in a range from 0.1 $A/dm^2$ to 1.0 $A/dm^2$ for 60 seconds to 120 seconds, the current density continuous-increasing stage controlling the first current density to continuously increase by 5 to 10 increments, and each of the increments being in a range from 0.1 $A/dm^2$ to 0.5 $A/dm^2$ and within a time period from 3 seconds to 10 seconds, the manufacturing method of an aluminum-based article having multi-angle visual color change characteristics of the present disclosure can increase decorativeness of an aluminum alloy surface and change the coloration effect of the aluminum alloy surface, and is not limited by complex three-dimensional shapes. Specifically, the aluminum alloy surface can show different colors at different viewing angles, and produce a color flow effect as the viewing angle changes, thus improving appearance quality.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
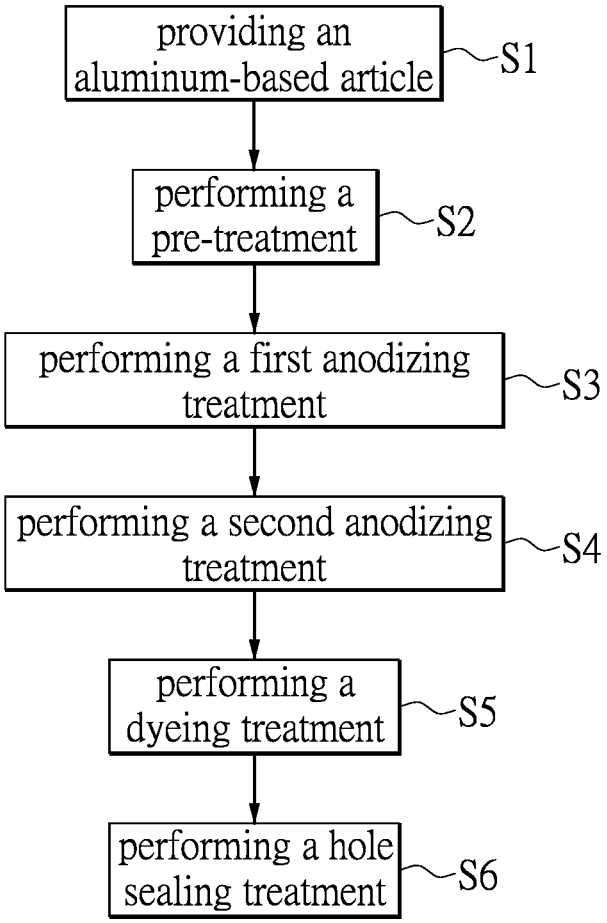
FIG. 1 is a flowchart of a manufacturing method of an aluminum-based article having multi-angle visual color change characteristics according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Unless otherwise stated, the material(s) used in any described embodiment is/are commercially available material(s) or may be prepared by methods known in the art, and the operation(s) or instrument(s) used in any described embodiment is/are conventional operation(s) or instrument(s) generally known in the related art.

Although any steps shown in a flowchart are described herein in a specific order, the steps are not required or implied to be executed in said specific order or all executed to achieve desired results. In practice, two or more steps can be optionally combined into one step, or one step can be optionally divided into two or more steps.

Referring to FIG. 1, an embodiment of the present disclosure provides a manufacturing method of an aluminum-based article having multi-angle visual color change characteristics, which mainly includes: step S1, providing an aluminum-based article; and step S3, performing a first anodizing treatment. In order to achieve different coloring effects on an aluminum alloy surface, the manufacturing method can further include: step S4, performing a second anodizing treatment; step S5, performing a dyeing treatment; and/or step S6, performing a hole sealing treatment. More specifically, a technical proposal of the embodiment of the present disclosure is to produce a color gradient and multiple color variations on an aluminum alloy surface by a special pulse-type anodizing treatment optionally cooperated with a general anodizing treatment and/or a dyeing treatment.

More details about each step of the manufacturing method of an aluminum-based article having multi-angle visual color change characteristics will be described below with reference to FIG. 2 to FIG. 10.

In step S1, the aluminum-based article 1 can be made of aluminum or its alloys, and preferably 1000 series, 5000 series, 6000 series, and 7000 series aluminum materials. However, such examples are not meant to limit the scope of the present disclosure. Furthermore, the aluminum-based article 1 can have a desired shape (e.g., a sheeted shape) by casting, extruding, forging, cutting, or other manners, such that it can be used for appearance parts of electronic products.

In step S3, the first anodizing treatment is performed on the aluminum-based article 1 in a first electrolytic solution. In an execution process, the aluminum-based article serves as an anode and a cathode is made of a corrosion-resistant material such as a stainless steel or carbon plate, and specific operating conditions are used to promote the formation of a porous aluminum oxide layer 2 that is well adhered on an outer surface 100 of the aluminum-based article 1. The first electrolytic solution can include 5 wt % to 15 wt % of sulfuric acid, 5 wt % to 15 wt % of oxalic acid, or the combination thereof, based on a total weight thereof being 100 wt %. Preferably, the first electrolytic solution further includes 1 wt % to 10 wt % of glycerol and has a temperature ranging from 10° C. to 20° C.

Figure 2:
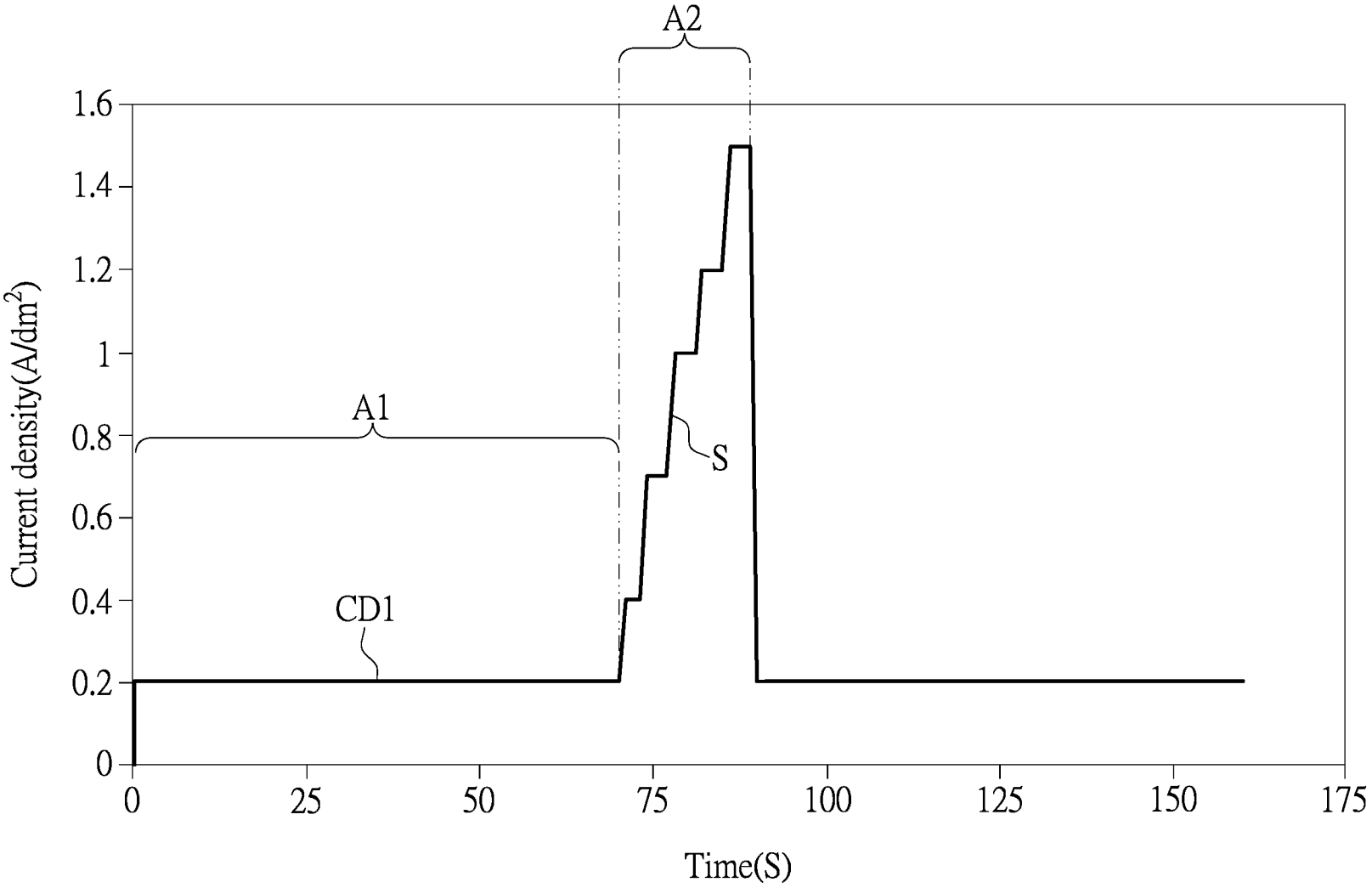
FIG. 2 is a schematic view showing different operational stages of a first operation mode of a first anodizing treatment used in step S2 of the manufacturing method of the aluminum-based article having multi-angle visual color change characteristics according to the embodiment of the present disclosure.
Figure 4:
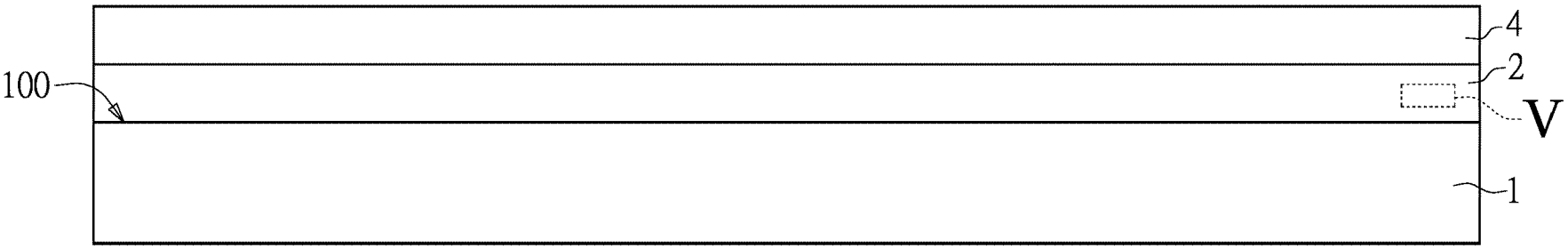
FIG. 4 is a structural schematic view showing a product obtained by the manufacturing method of the aluminum-based article having multi-angle visual color change characteristics according to the embodiment of the present disclosure.
Figure 5:
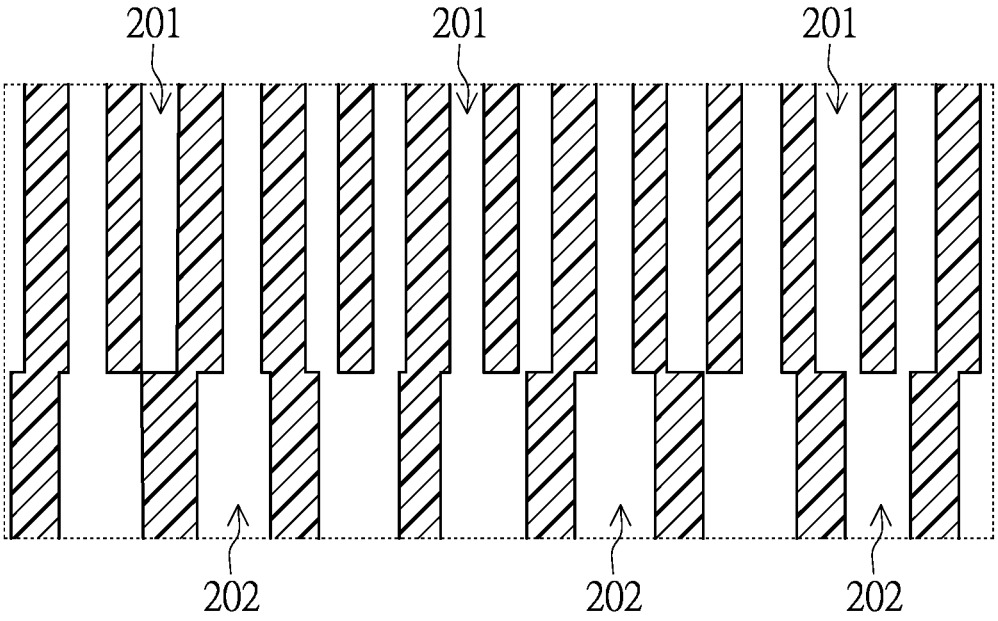
FIG. 5 is a schematic enlarged view of part V of FIG. 4, which shows a porous aluminum oxide layer formed by using the first operation mode.
Figure 6:
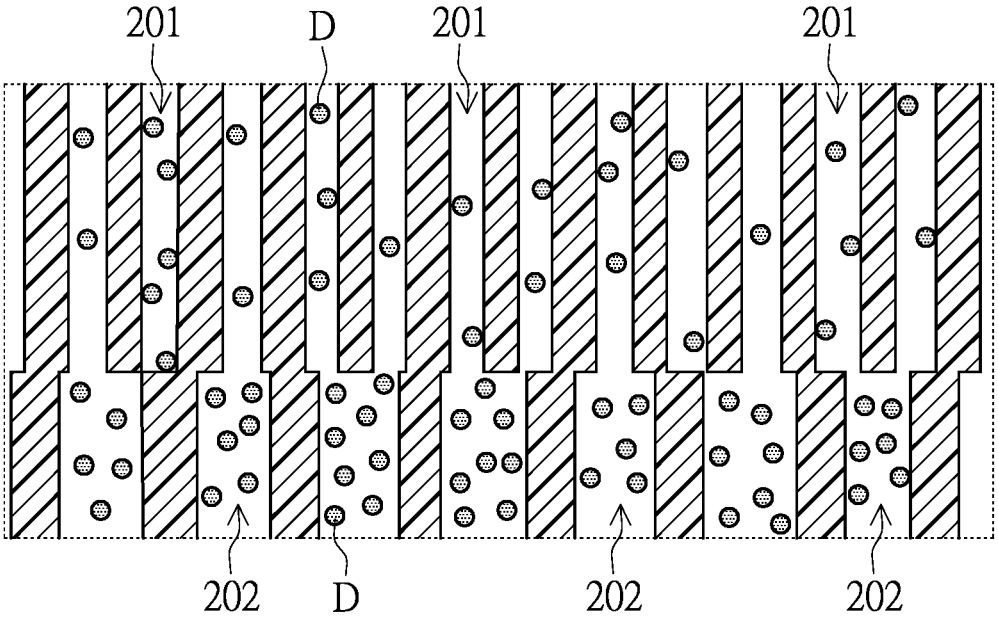
FIG. 6 is a variation of FIG. 5 and shows the porous aluminum oxide layer formed by using the first operation mode and containing a dye.

It should be noted that the first anodizing treatment is a special pulse-type anodizing treatment, which includes cycling a first operation mode 50 times to 80 times. As shown in FIG. 2, the first operation mode includes a first constant-current density stage A1 followed by a current density continuous-increasing stage A2. Accordingly, as shown in FIG. 4 and FIG. 5, the porous aluminum oxide layer 2 has a plurality of upper pores 201 (i.e., pores in an upper layered structure) and a plurality of lower pores 202 (i.e., pores in a lower layered structure) which are different in structure and distribution, thereby producing multi-angle visual color change effects. For example, in the porous aluminum oxide layer 2, the upper pores 201 are arranged in a dense distribution and the lower pores 202 are arranged in a sparse distribution, and the diameter, depth, or shape of the upper pores 201 is different from that of the lower pores 202. However, the above description is for exemplary purposes only, and is not meant to limit the scope of the present disclosure.

More specifically, in the first constant-current density stage A1, a first current density CD1 is controlled to be constant in a range from 0.1 A/dm$^2$ to 1.0 A/dm$^2$ for 60 seconds to 120 seconds. In the current density continuous-increasing stage A2, the first current density CD1 is controlled to continuously increase by 5 to 10 increments S, and each of the increments S is in a range from 0.1 A/dm$^2$ to 0.5 A/dm$^2$ and within a time period from 3 seconds to 10 seconds.

Figure 3:
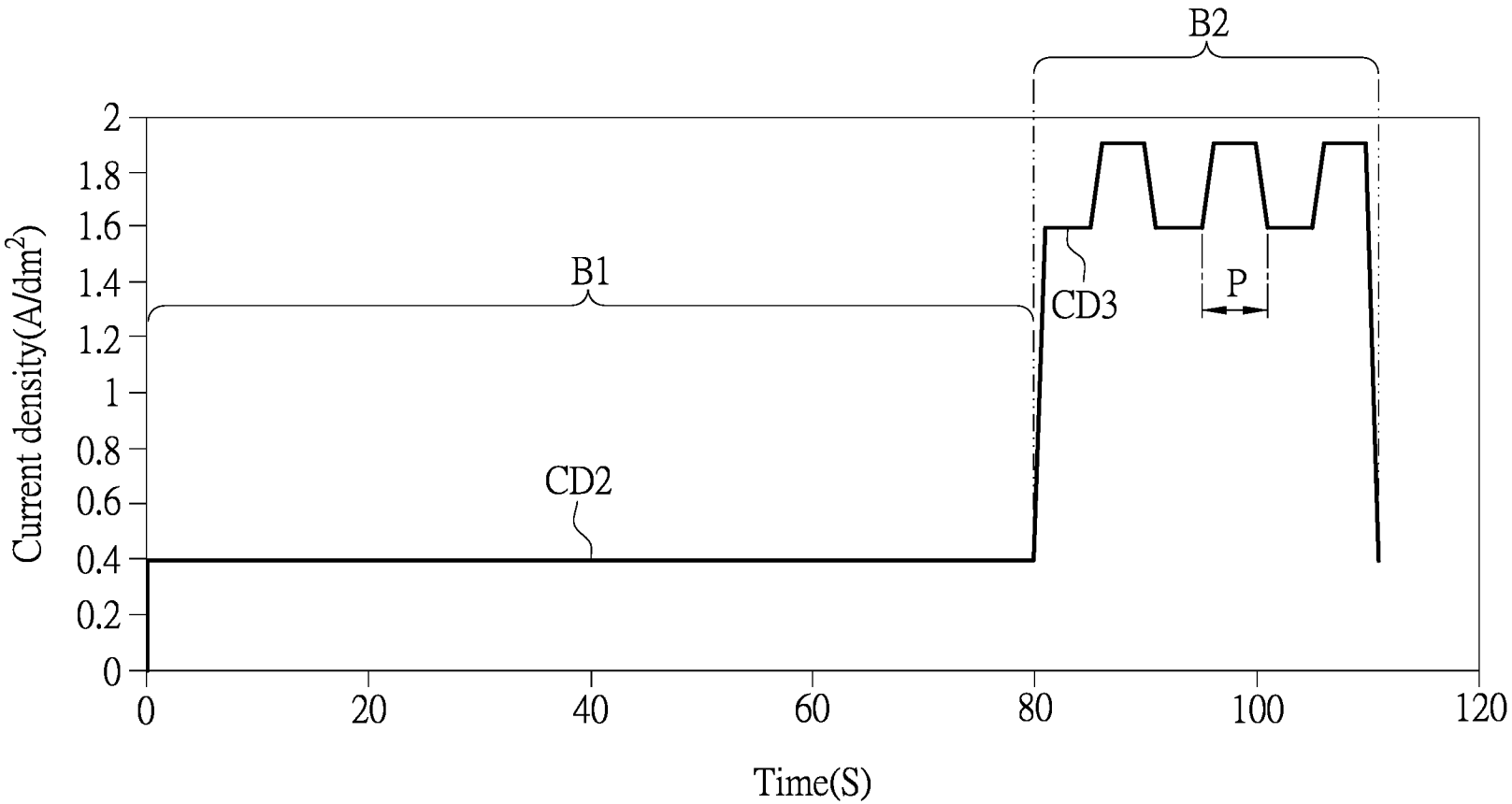
FIG. 3 is a schematic view showing different operational stages of a second operation mode of the first anodizing treatment used in step S2 of the manufacturing method of the aluminum-based article having multi-angle visual color change characteristics according to the embodiment of the present disclosure.
Figure 7:
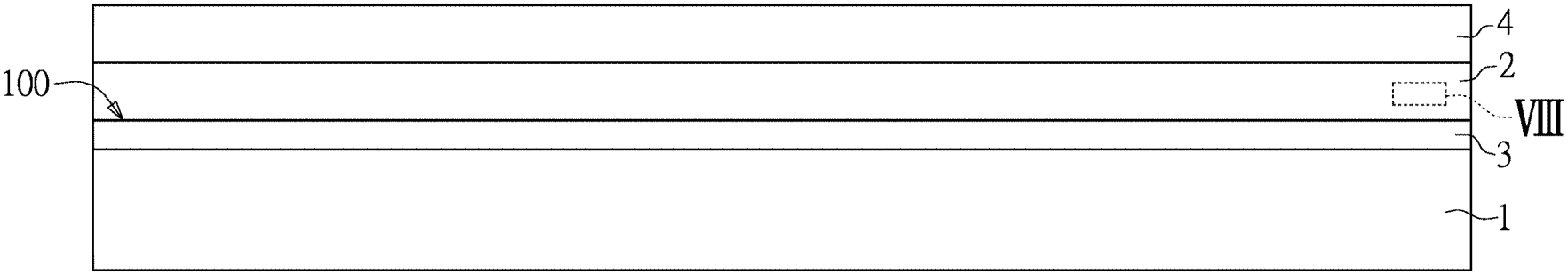
FIG. 7 is another structural schematic view showing a product obtained by the manufacturing method of the aluminum-based article having multi-angle visual color change characteristics according to the embodiment of the present disclosure.
Figure 8:
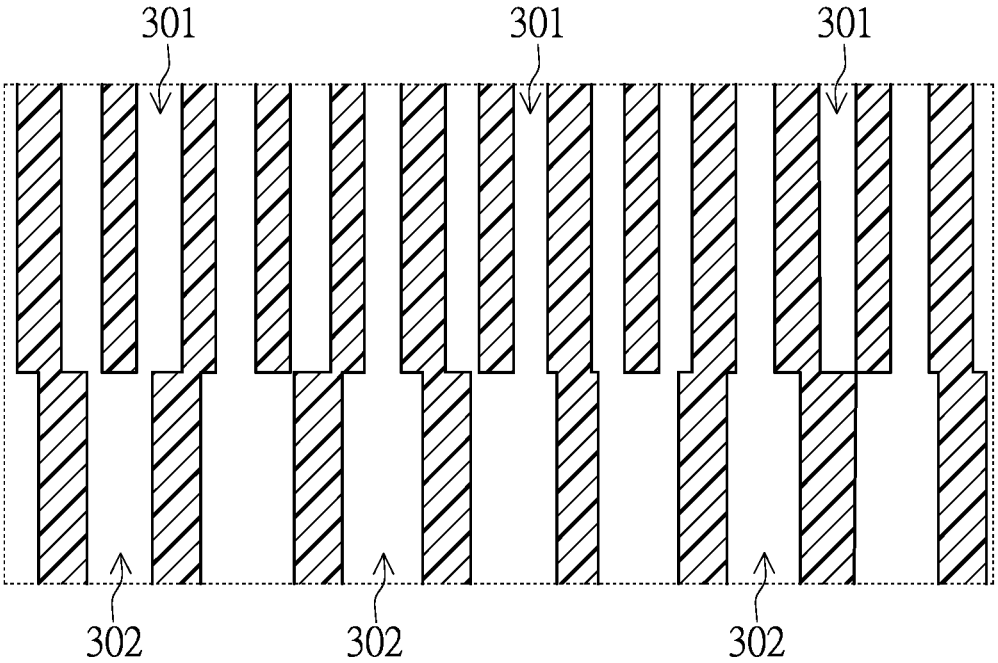
FIG. 8 is a schematic enlarged view of part VIII of FIG. 7, which shows a porous aluminum oxide layer formed by using a second operation mode.
Figure 9:
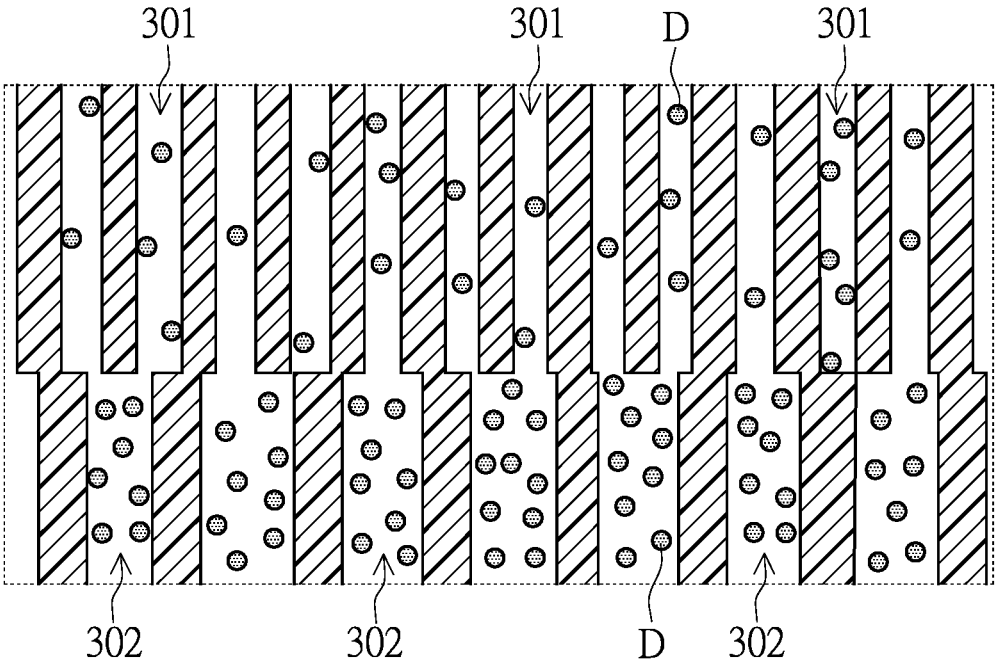
FIG. 9 is a variation of FIG. 7 and shows the porous aluminum oxide layer formed by using the second operation mode and containing a dye.

In order to achieve a superimposition effect of color variations, the first anodizing treatment of step S3 further includes cycling a second operation mode 10 times to 50 times after the cycling operation of the first operation mode. As shown in FIG. 3, the second operation mode includes a second constant-current density stage B1 followed by a high current density pulse stage B2. Accordingly, as shown in FIG. 7 and FIG. 8, another porous aluminum oxide layer 3 is formed between the outer surface 100 of the aluminum-based article 1 and the porous aluminum oxide layer 2. The porous aluminum oxide layer 3 has a plurality of upper pores 301 (i.e., pores in an upper layered structure) and a plurality of lower pores 302 (i.e., pores in a lower layered structure) which are different in structure and distribution. For example, in the porous aluminum oxide layer 3, the upper pores 301 are arranged in a dense distribution and the lower pores 302 are arranged in a sparse distribution, and the diameter, depth, or shape of the upper pores 301 is different from that of the lower pores 302. However, the above description is for exemplary purposes only, and is not meant to limit the scope of the present disclosure.

More specifically, in the second constant-current density stage B1, a second current density CD2 is controlled to be constant in a range from 0.3 A/dm$^2$ to 1.0 A/dm$^2$ for 70 seconds to 120 seconds. In the high current density pulse stage B2, the second current density CD2 is increased to a baseline current density CD3 and a plurality of micro-pulses P greater than 0.5-1 A/dm$^2$ of the baseline current density CD3 are generated. The baseline current density CD3 ranges from 1.5 A/dm$^2$ to 2.5 A/dm$^2$, and each of the micro-pulses P is within a time period from 5 seconds to 15 seconds.

As shown in FIG. 1, the manufacturing method of an aluminum-based article having multi-angle visual color change characteristics of the present disclosure can further include a pre-treatment step, i.e., step S2, performing a pre-treatment on the aluminum-based article 1, before the first anodizing treatment is performed. The means of the pre-treatment varies with different purposes, and can include, for example, degreasing, acid washing, alkaline washing, or any combination thereof, so as to remove defects, dirt, organic substances, natural oxide films, and so on, that may be present on the outer surface 100 of the aluminum-based article 1. Alternatively, the means of the pre-treatment can include sandblasting, diamond cutting, chemical polishing, or any combination thereof, so as to create a special surface effect.

In the embodiment of the present disclosure, in a degreasing process, the aluminum-based article 1 can be immersed in a 50° C. degreasing agent solution for 1 minute to 3 minutes. In an acid washing process, the aluminum-based article 1 can be immersed in an acid solution with a temperature from 20° C. to 40° C. for 1 minute to 3 minutes. In an alkaline washing process, the aluminum-based article 1 can be immersed in an alkaline solution with a temperature from 40° C. to 60° C. for 0.5 minute to 2 minutes. The outer surface 100 of the aluminum-based article 1 can have a matte effect by sandblasting. The aluminum-based article 1 can have a flat and smooth cut surface by diamond cutting. The outer surface 100 of the aluminum-based article 1 can have a gloss between 80 GU and 1000 GU at a 60 degree angle by chemical polishing, in which a chemical polishing solution can include phosphoric acid or the combination of phosphoric acid and sulfuric acid.

In practice, after step S3 is completed, the method can proceed to step S5 followed by step S6. As shown in FIG. 4 to FIG. 9, in step S5, the dyeing treatment is performed in a manner of immersion, in which the aluminum-based article 1 is immersed in a dyeing solution, such that at least one dye D is deposited on the aluminum-based article 1 and at least partially fills into pores (upper pores 201 or 301 and lower pores 202 or 302) of the porous aluminum oxide layer 2 (when only the first operation mode is conducted) or the porous aluminum oxide layer 3 (when both the first operation mode and the second operation mode are conducted). If necessary, a water washing process can be used to remove the excess dye D. It is worth mentioning that one aspect of the present disclosure is to control the color of the porous aluminum oxide layer 2 (or the porous aluminum oxide layer 3) by adjusting the parameters of the first operation mode (or the second operation mode) of the first anodizing treatment, while using one or more dyes for color adjustment, such that the aluminum-based article 1 can exhibit multiple color variations.

In step S6, the hole sealing treatment includes applying a coating material onto the aluminum-based article 1 and carrying out a cross-linking reaction by baking or ultraviolet (UV) irradiation to cure a resulting coating. Accordingly, a transparent sealing layer 4 is formed on the porous aluminum oxide layer 2 or 3 to seal the pores. In the presence of the transparent sealing layer 4, the at least one dye D can be stably retained in the pores of the porous aluminum oxide layer 2 or 3 for a long period of time. The coating material includes a polymer material selected from the group consisting of polyurethane, polycarbonate, aminosiloxane, epoxy siloxane, and a nano-silicon composite material, and can be applied by spraying or electro-coating. However, such examples are not meant to limit the scope of the present disclosure.

According to requirements of product appearance, after the first anodizing treatment of step S3 is completed, the method can skip the dyeing treatment of step S5 and proceed to the hole sealing treatment of step S6. After that, the method is concluded.

Figure 10:
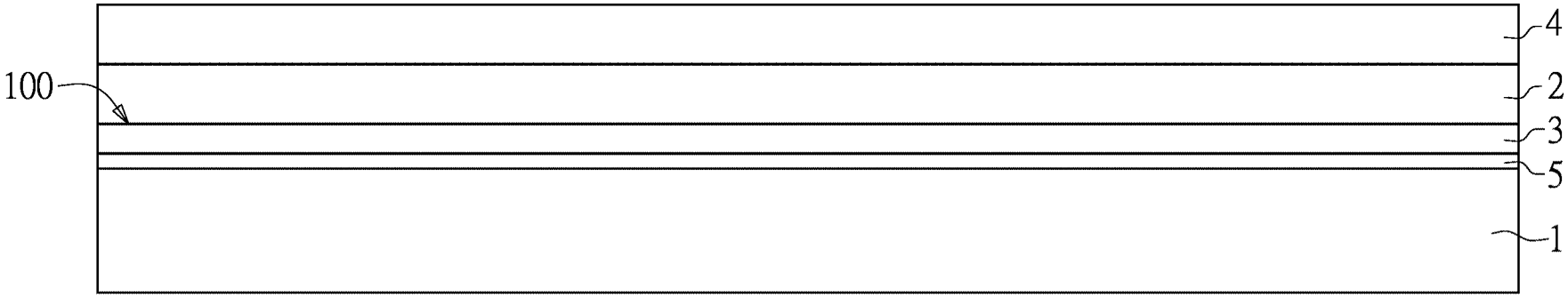
FIG. 10 is a still another structural schematic view showing a product obtained by the manufacturing method of the aluminum-based article having multi-angle visual color change characteristics according to the embodiment of the present disclosure.

Referring to FIG. 1, which is to be read in conjunction with FIG. 10, the manufacturing method of an aluminum-based article having multi-angle visual color change characteristics of the present disclosure can further include a step of performing a second anodizing treatment on the aluminum-based article (i.e., step S4) between the step of performing the first anodizing treatment (i.e., step S3) and the step of performing the dyeing treatment (i.e., step S5) or the step of performing the hole sealing treatment (i.e., step S6). In step S4, the second anodizing treatment is performed on the aluminum-based article 1 in a second electrolytic solution. In an execution process, the aluminum-based article 1 serves as an anode and a cathode is made of a corrosion-resistant material such as a stainless steel or carbon plate, and still another porous aluminum oxide layer 5 is formed under specific operating conditions and between the outer surface 100 of the aluminum-based article 1 and the porous aluminum oxide layer 2 or 3, thereby creating an appearance with multiple color variations and multi-level color changes due to color mixing and color superimposition.

More specifically, the second electrolytic solution can include 5 wt % to 15 wt % of sulfuric acid, 5 wt % to 20 wt % of acetic acid, 2 wt % to 10 wt % of phosphoric acid, or any combination thereof, based on a total weight thereof being 100 wt %, and has a temperature ranging from 50° C. to 70° C. The second anodizing treatment can be performed at an operating voltage from 10V to 15V for 0.5 minutes to 10 minutes. Accordingly, the porous aluminum oxide layer 5 can be formed with pores that are in a regular arrangement and have good uniformity.

The manufacturing method of an aluminum-based article having multi-angle visual color change characteristics of the present disclosure will be further explained with the following specific examples. However, said specific examples are disclosed for exemplary purposes only, and are not meant to limit the scope of the present disclosure.

Specific Example 1

Rounded steel grits (120 grit) are used to sandblast an outer surface of an aluminum alloy article made of 5052 aluminum alloy. Afterwards, a surface degreasing treatment is performed on the aluminum alloy article at 50° C. for 3 minutes, so as to remove dirt and oil stains on the outer surface. Afterwards, an acid washing treatment is performed on the aluminum alloy article at 30° C. for 1 minute, so as to remove oxides and contaminants on the outer surface. Afterwards, an alkaline washing treatment is performed on the aluminum alloy article at 60° C. for 0.5 minutes, so as to increase surface cleanliness. Afterwards, the aluminum alloy article is subjected to chemical polishing, so as to remove surface contaminants and increase surface gloss and uniformity. Afterwards, a first anodizing treatment is performed on the aluminum alloy article, which includes cycling a first operation mode 50 times to 80 times under operating conditions as shown in FIG. 2. Afterwards, another acid washing treatment is performed on the aluminum alloy article in a treating solution including 10 wt % of nitric acid at 30° C. for 3 minutes. Afterwards, a dyeing treatment using an Okuno dye is performed on the aluminum alloy article at 50° C. for 5 minutes. Lastly, a nickel-free hole sealing treatment is performed on the aluminum alloy article.

Specific Example 2

Rounded steel grits (120 grit) are used to sandblast an outer surface of an aluminum alloy article made of 6063 aluminum alloy. Afterwards, a surface degreasing treatment is performed on the aluminum alloy article at 50° C. for 3 minutes, so as to remove dirt and oil stains on the outer surface. Afterwards, an acid washing treatment is performed on the aluminum alloy article at 30° C. for 1 minute, so as to remove oxides and contaminants on the outer surface. Afterwards, an alkaline washing treatment is performed on the aluminum alloy article at 60° C. for 0.5 minutes, so as to increase surface cleanliness. Afterwards, the aluminum alloy article is subjected to chemical polishing, so as to remove surface contaminants and increase surface gloss and uniformity. Afterwards, a first anodizing treatment is performed on the aluminum alloy article, which includes cycling a first operation mode 50 times to 80 times under operating conditions as shown in FIG. 2 and cycling a second operation mode 10 times to 50 times under operating conditions as shown in FIG. 3. Afterwards, another acid washing treatment is performed on the aluminum alloy article in a treating solution including 10 wt % of nitric acid at 30° C. for 3 minutes. Afterwards, a dyeing treatment using an Okuno dye is performed on the aluminum alloy article at 50° C. for 5 minutes. Lastly, a nickel-free hole sealing treatment is performed on the aluminum alloy article.

Specific Example 3

Rounded steel grits (120 grit) are used to sandblast an outer surface of an aluminum alloy article made of 5052 aluminum alloy. Afterwards, a surface degreasing treatment is performed on the aluminum alloy article at 50° C. for 3 minutes, so as to remove dirt and oil stains on the outer surface. Afterwards, an acid washing treatment is performed on the aluminum alloy article at 30° C. for 1 minute, so as to remove oxides and contaminants on the outer surface. Afterwards, an alkaline washing treatment is performed on the aluminum alloy article at 60° C. for 0.5 minutes, so as to increase surface cleanliness. Afterwards, the aluminum alloy article is subjected to chemical polishing, so as to remove surface contaminants and increase surface gloss and uniformity. Afterwards, a first anodizing treatment is performed on the aluminum alloy article, which includes cycling a first operation mode 50 times to 80 times under operating conditions as shown in FIG. 2 and cycling a second operation mode 10 times to 50 times under operating conditions as shown in FIG. 3. Afterwards, a second anodizing treatment is performed on the aluminum alloy article in an electrolytic solution including 8 wt % of sulfuric acid and 7 wt % of acetic acid at 60° C. and 10V for 3 minutes. Afterwards, another acid washing treatment is performed on the aluminum alloy article in a treating solution including 10 wt % of nitric acid at 30° C. for 3 minutes. Afterwards, a dyeing treatment using an Okuno dye is performed on the aluminum alloy article at 50° C. for 5 minutes. Lastly, a nickel-free hole sealing treatment is performed on the aluminum alloy article.

Specific Example 4

An aluminum alloy article made of 6063 aluminum alloy is formed with a cut surface having a gloss from 200 GU to 1000 GU by diamond cutting. Afterwards, a surface degreasing treatment is performed on the aluminum alloy article at 50° C. for 3 minutes, so as to remove dirt and oil stains on an outer surface of the aluminum alloy article. Afterwards, an acid washing treatment is performed on the aluminum alloy article at 30° C. for 1 minute, so as to remove oxides and contaminants on the outer surface. Afterwards, a first anodizing treatment is performed on the aluminum alloy article, which includes cycling a first operation mode 50 times to 80 times under operating conditions as shown in FIG. 2 and cycling a second operation mode 10 times to 50 times under operating conditions as shown in FIG. 3. Afterwards, a second anodizing treatment is performed on the aluminum alloy article in an electrolytic solution including 8 wt % of sulfuric acid and 7 wt % of acetic acid at 50° C. and 15V for 3 minutes. Afterwards, another acid washing treatment is performed on the aluminum alloy article in a treating solution including 15 wt % of nitric acid at 30° C. for 3 minutes. Afterwards, a dyeing treatment using an Okuno dye is performed on the aluminum alloy article at 50° C. for 5 minutes. Lastly, a nickel-free hole sealing treatment is performed on the aluminum alloy article.

Beneficial Effects of the Embodiments

In conclusion, by virtue of performing a first anodizing treatment that includes cycling a first operation mode 50 times to 80 times on the aluminum-based article, the first operation mode including a first constant-current density stage followed by a current density continuous-increasing stage, the first constant-current density stage controlling a first current density to be constant in a range from 0.1 A/dm$^2$ to 1.0 A/dm$^2$ for 60 seconds to 120 seconds, the current density continuous-increasing stage controlling the first current density to continuously increase by 5 to 10 increments, and each of the increments being in a range from 0.1 A/dm$^2$ to 0.5 A/dm$^2$ and within a time period from 3 seconds to 10 seconds, the manufacturing method of an aluminum-based article having multi-angle visual color change characteristics of the present disclosure can increase decorativeness of an aluminum alloy surface and change the coloration effect of the aluminum alloy surface, and is not limited by complex three-dimensional shapes. Specifically, the aluminum alloy surface can show different colors at different viewing angles, and produce a color flow effect as the viewing angle changes, thus improving appearance quality.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A manufacturing method of an aluminum-based article having multi-angle visual color change characteristics, comprising:

providing an aluminum-based article; and performing a first anodizing treatment on the aluminum-based article, which includes cycling a first operation mode 50 times to 80 times;

wherein the first operation mode includes a first constant-current density stage followed by a current density continuous-increasing stage; wherein, in the first constant-current density stage, a first current density is controlled to be constant in a range from 0.1 A/dm$^2$ to 1.0 A/dm$^2$ for 60 seconds to 120 seconds; wherein, in the current density continuous-increasing stage, the first current density is controlled to continuously increase by 5 to 10 increments, and each of the increments is in a range from 0.1 A/dm$^2$ to 0.5 A/dm$^2$ and within a time period from 3 seconds to 10 seconds.

2. The manufacturing method according to claim 1, wherein the first anodizing treatment is performed in a first electrolytic solution with a temperature ranging from 10° C. to 20° C., and the first electrolytic solution includes 5 wt % to 15 wt % of sulfuric acid, 5 wt % to 15 wt % of oxalic acid, or the combination thereof, based on a total weight thereof being 100 wt %.

3. The manufacturing method according to claim 2, wherein the first electrolytic solution further includes 1 wt % to 10 wt % of glycerol.

4. The manufacturing method according to claim 1, wherein, after the step of performing the first anodizing treatment, the manufacturing method further comprises: performing a second anodizing treatment on the aluminum-based article undergoing the first anodizing treatment, wherein the second anodizing treatment is performed at an operating voltage from 10V to 15V for 0.5 minutes to 10 minutes.

5. The manufacturing method according to claim 4, wherein the second anodizing treatment is performed in a second electrolytic solution with a temperature ranging from 50° C. to 70° C., and the second electrolytic solution includes 5 wt % to 15 wt % of sulfuric acid, 5 wt % to 20 wt % of acetic acid, 2 wt % to 10 wt % of phosphoric acid, or any combination thereof, based on a total weight thereof being 100 wt %.

6. The manufacturing method according to claim 4, wherein, after the step of performing the first anodizing treatment or the second anodizing treatment, the manufacturing method further comprises: performing a dyeing treatment on the aluminum-based article undergoing the first anodizing treatment or the second anodizing treatment, such that a plurality of pores of a porous aluminum oxide layer formed by the first anodizing treatment or the second anodizing treatment are filled with at least one dye.

7. The manufacturing method according to claim 6, wherein, after the step of performing the dyeing treatment, the manufacturing method further comprises: performing a hole sealing treatment on the aluminum-based article undergoing the dyeing treatment.

8. The manufacturing method according to claim 7, wherein the hole sealing treatment includes forming a transparent sealing layer on the porous aluminum oxide layer to seal the pores, and the transparent sealing layer includes a polymer material selected from the group consisting of polyurethane, polycarbonate, aminosiloxane, epoxy siloxane, and a nano-silicon composite material.

9. The manufacturing method according to claim 1, wherein the first anodizing treatment includes cycling a second operation mode 10 times to 50 times after the cycling of the first operation mode, and the second operation mode includes a second constant-current density stage followed by a high current density pulse stage;

wherein, in the second constant-current density stage, a second current density is controlled to be constant in a range from 0.3 $A/dm^2$ to 1.0 $A/dm^2$ for 70 seconds to 120 seconds; wherein, in the high current density pulse stage, the second current density is increased to a baseline current density and a plurality of micro-pulses greater than 0.5-1 $A/dm^2$ of the baseline current density are generated, and each of the micro-pulses is within a time period from 5 seconds to 15 seconds.

10. The manufacturing method according to claim 9, wherein the first anodizing treatment is performed in a first electrolytic solution with a temperature ranging from 10° C. to 20° C., and the first electrolytic solution includes 5 wt % to 15 wt % of sulfuric acid, 5 wt % to 15 wt % of oxalic acid, or the combination thereof, based on a total weight thereof being 100 wt %.

11. The manufacturing method according to claim 10, wherein the first electrolytic solution further includes 1 wt % to 10 wt % of glycerol.

12. The manufacturing method according to claim 9, wherein, after the step of performing the first anodizing treatment, the manufacturing method further comprises: performing a second anodizing treatment on the aluminum-based article undergoing the first anodizing treatment, wherein the second anodizing treatment is performed at an operating voltage from 10V to 15V for 0.5 minutes to 10 minutes.

13. The manufacturing method according to claim 12, wherein the second anodizing treatment is performed in a second electrolytic solution with a temperature ranging from 50° C. to 70° C., and the second electrolytic solution includes 5 wt % to 15 wt % of sulfuric acid, 5 wt % to 20 wt % of acetic acid, 2 wt % to 10 wt % of phosphoric acid, or any combination thereof, based on a total weight thereof being 100 wt %.

14. The manufacturing method according to claim 12, wherein, after the step of performing the first anodizing treatment or the second anodizing treatment, manufacturing method further comprises: performing a dyeing treatment on the aluminum-based article undergoing the first anodizing treatment or the second anodizing treatment, such that a plurality of pores of a porous aluminum oxide layer formed by the first anodizing treatment or the second anodizing treatment are filled with at least one dye.

15. The manufacturing method according to claim 14, wherein, after the step of performing the dyeing treatment, manufacturing method further comprises: performing a hole sealing treatment on the aluminum-based article undergoing the dyeing treatment.

16. The manufacturing method according to claim 15, wherein the hole sealing treatment includes forming a transparent sealing layer on the porous aluminum oxide layer to seal the pores, and the transparent sealing layer includes a polymer material selected from the group consisting of polyurethane, polycarbonate, aminosiloxane, epoxy siloxane, and a nano-silicon composite material.

17. The manufacturing method according to claim 15, wherein, before the step of performing the first anodizing treatment, the manufacturing method further comprises: subjecting the aluminum-based article to chemical polishing, such that an outer surface of the aluminum-based article has a gloss ranging from 80 GU to 1000 GU at a 60 degree angle.

* * * * *